US012084234B2

(12) United States Patent
Lewandowski et al.

(10) Patent No.: US 12,084,234 B2
(45) Date of Patent: Sep. 10, 2024

(54) MECHANISM FOR OPENING AND RECLOSING THE OUTFLOW OPENING FOR EMPTYING A CONTAINER

(71) Applicant: REEND SPOLKA Z OGRANICZONA ODPOWIEDZIALNOSCIA, Krzemieniewo (PL)

(72) Inventors: Dariusz Lewandowski, Warsaw (PL); Roman Sobecki, Gostyn (PL)

(73) Assignee: Reend Spolka z Ograniczona Odpowiedzialnoscia, Krzemieniewo (PL)

( * ) Notice: Subject to any disclaimer, the term of this patent is extended or adjusted under 35 U.S.C. 154(b) by 0 days.

(21) Appl. No.: 18/030,367

(22) PCT Filed: Nov. 27, 2020

(86) PCT No.: PCT/PL2020/000086
§ 371 (c)(1),
(2) Date: Apr. 5, 2023

(87) PCT Pub. No.: WO2022/075865
PCT Pub. Date: Apr. 14, 2022

(65) Prior Publication Data

US 2023/0271757 A1 Aug. 31, 2023

(30) Foreign Application Priority Data

Oct. 11, 2020 (PL) ..... 435640

(51) Int. Cl.
*B65D 47/26* (2006.01)
*B65D 51/18* (2006.01)

(52) U.S. Cl.
CPC ..... *B65D 47/265* (2013.01); *B65D 51/18* (2013.01); *B65D 2251/0012* (2013.01); *B65D 2543/00046* (2013.01)

(58) Field of Classification Search
CPC ..... B65D 47/265; B65D 51/18; B65D 2251/0012; B65D 2543/00046
(Continued)

(56) References Cited

U.S. PATENT DOCUMENTS 2,533,915 A 12/1950 Brooks
5,205,430 A * 4/1993 Valyi ..... B65D 51/228 220/267
(Continued)

FOREIGN PATENT DOCUMENTS

WO 20080051099 A1 5/2008
WO 20160130705 A1 8/2016

OTHER PUBLICATIONS

Written Opinion of the International Searching Authority and International Search Report issued by European Patent Office for corresponding International Patent Application No. PCT/PL2020/000086, mailed on Jul. 14, 2021.

*Primary Examiner* — James N Smalley
(74) *Attorney, Agent, or Firm* — Myers Wolin, LLC

(57) ABSTRACT

A mechanism for opening and reclosing the outflow opening for emptying a container, incorporating a latch featuring the means to initiate movement of the latch, with the latch connected rotationally to the lid featuring the outflow opening for emptying the container, characterised in that formed on the bottom surface of the lid is at least one guide with an arched guiding surface going down in a screw-like manner with respect to the bottom surface of the lid, and the latch features at least one hatch with an arched surface shaped on the bottom surface of the latch, where the said arched surface goes down in a screw-like manner with respect to the
(Continued)

top surface of the latch, and where the hatch is fitted slidingly on the said guide, so that the arched surface of the latch contacts the arched guiding surface of the guide.

13 Claims, 16 Drawing Sheets

(58) Field of Classification Search
USPC ..... 220/253, 254.8
See application file for complete search history.

(56) References Cited

U.S. PATENT DOCUMENTS

| | | | | |
|---|---|---|---|---|
| 9,517,866 | B2 * | 12/2016 | Coffey | B65D 51/1688 |
| 11,246,434 | B2 * | 2/2022 | Siegenthaler | B65D 47/265 |
| 2003/0089713 | A1 * | 5/2003 | Belt | B65D 47/265 220/253 |
| 2006/0096983 | A1 * | 5/2006 | Patterson | B65D 47/265 220/253 |
| 2007/0029322 | A1 * | 2/2007 | Durdon | B65D 43/0212 229/404 |
| 2008/0029512 | A1 * | 2/2008 | Smith | B65D 47/286 220/253 |
| 2010/0155358 | A1 * | 6/2010 | George | B65D 47/244 215/356 |
| 2013/0292381 | A1 * | 11/2013 | Chen | B65D 43/0212 220/254.4 |
| 2015/0251818 | A1 * | 9/2015 | Strachan | B65D 43/18 220/254.8 |
| 2020/0039700 | A1 * | 2/2020 | Coffey | B65D 51/1688 |
| 2020/0130904 | A1 * | 4/2020 | Jones | B65D 47/244 |

* cited by examiner

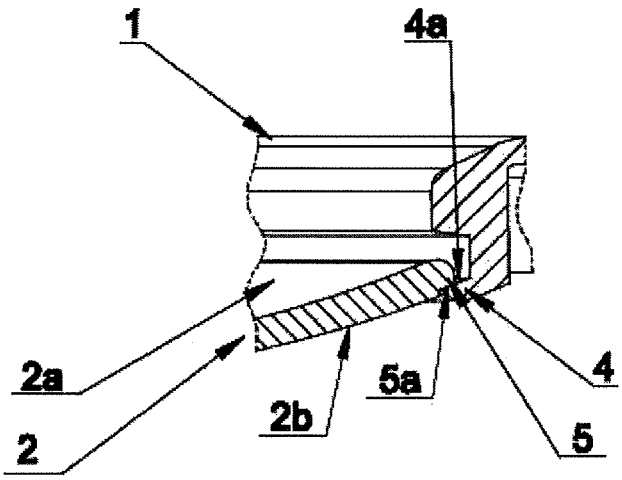
Fig. 27
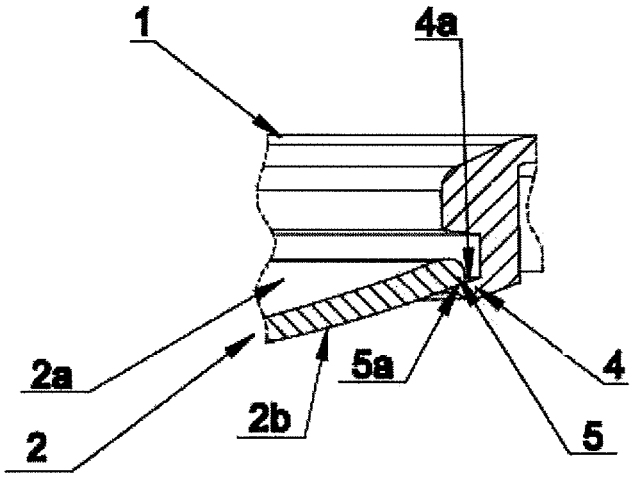
Fig. 27A
Fig. 28
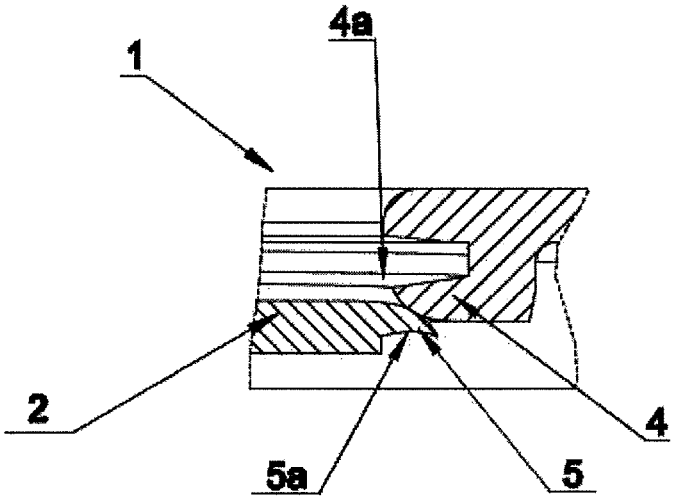

MECHANISM FOR OPENING AND RECLOSING THE OUTFLOW OPENING FOR EMPTYING A CONTAINER

CROSS REFERENCE TO RELATED APPLICATIONS

The present application is a U.S. National Phase under 35 U.S.C. 371 of International Patent Application Serial No. PCT/PL2020/000086, filed on Nov. 27, 2020, which claims priority to Polish Application P.435640, filed on Oct. 11, 2020, the contents of each of which are incorporated by reference in their entirety for all purposes.

FIELD OF THE INVENTION

The invention concerns a mechanism for opening and reclosing the outflow opening for emptying a container, intended especially for containers made of plastic, bottles included.

BACKGROUND

Known from patent document WO 2008/051099 A1 is a lid of a container made of plastic, intended especially for beverages, made up of a body and device for opening and reclosing the outflow opening which is closed tightly before it is opened for the first time with a valve featuring an opening, around which, along the plane perpendicular to its surface, there are at least two clasps fixed rotationally in the assembly hole on the inner side of the lid, where the clasps cooperate with the lever featuring an arm ended with a cylindrical element, the latter fitted on the side surface with at least one driver and fixed rotationally in the assembly hole on the outer side of the lid. The valve and lever are sealed and fixed in place with a plastic foil. Once the outflow opening is opened, it can be closed back by shifting the actuating mechanism.

Known from document WO 2016/130705 A1 is a closing device in which the panel covering the opening in the lid is joined with the lid via a rivet around which the covering panel can rotate, either closing or opening the opening in the lid. Before the first opening, the above parts are coupled to one another, e.g. by gluing. The closing device is fitted with a rotating lever fixed to the lid and with a panel covering the opening, where the lever breaks the coupling between the said elements.

The pressure exerted so as to rotate the lever axially around the rivet enables disconnecting the panel which covers the opening from the lid, thus letting out the pressure from inside the container. The elements which make up the closing device are made of metal and plastic.

Generally known are devices closing containers made of plastic, bottles in particular, such as caps, which constitute a separate element once the container is opened. Because of the required mechanical properties, the weight of the threaded element represents a substantial percentage of the weight of the material the container is made of, in proportion to the container volume. By standard, the bottle and cap are made of different materials, which makes their recycling substantially hard because of the need to segregate them. In addition, in the perspective of the required implementation (e.g. under the SUP/single use plastic/EU directive) of the principles of the so called Circular Economy it must be emphasized that heterogeneity of the material used to make the entire packaging hinders or even precludes implementation of the circular economy principles. In the context of the requirement to eliminate any detachable elements from the consumption process (formulated e.g. by the EU Directive referred to above), it must be emphasised that there have been many solutions invented, which involve fitting the caps with additional attaching elements or membrane hinges. The solutions, however, are very complex, uncomfortable for the consumers, they practically do not guarantee non-detachability of the cap, and most of all severely complicate the technological possibility to recover the material the bottle is made of and to use it as a recycled material, which in turn will make recovery of the material for its reuse even harder, at times precluding it altogether, and in each case it will substantially raise the cost of such recovery (flotation process, water consumption), as in the case of the standard caps referred to above. Non-separable connection of heterogenous elements virtually precludes the possibility to obtain such a raw material in the recycling process which could be used to make the same objects, for instance a cap or container, of which it has been obtained in the recycling process, which is the essence of the circular economy.

SUMMARY

One of the problems which is solved by the described invention is the friction between the elements which mutually cooperate when opening and reclosing the outflow opening for emptying a container by reducing the friction; at the same time the invention ensures tight reclosing of the said opening. Reduced friction increases reliability of the functioning mechanism, reduces the risk of damaging it, pertains to its ergonomics whilst in operation, and eliminates generation of minute particles in consequence of abrasion of the cooperating surfaces, where the particles may contaminate the container content, e.g. beverage.

In addition, the purpose of the invention is to develop a mechanism for opening and reclosing containers, bottles included, which will be characterised by the following features:

- elimination of detachable elements from the consumption process,
- elimination of a thread, which reduces the weight of the containers, bottles in particular,
- homogeneity of material in the mechanism itself, and the possibility to fix the closing mechanism on a container made of the same material,
- simplicity in production and ergonomics of use thanks to the opening and reclosing with a single move, using the force of a single finger,
- reduction of the number of structural elements in the mechanism, simplification of the technological processes in production and of their assembly in the existing bottling lines,
- reduction of the production costs.

According to the invention, a mechanism for opening and reclosing the outflow opening for emptying a container, incorporating a latch featuring the means to initiate movement of the latch, with the latch connected rotationally to the lid featuring the outflow opening for emptying the container, is characterised in that formed on the bottom surface of the lid is at least one guide with an arched guiding surface going down in a screw-like manner with respect to the bottom surface of the lid, where the latch features at least one hatch with an arched surface shaped on the bottom surface of the latch, where the said arched surface goes down in a screw-like manner with respect to the top surface of the latch, and where the hatch is fitted slidingly on the said guide so that the arched surface of the latch contacts the arched guiding surface of the guide. In the closed position the top surface of the latch contacts the bottom surface of the lid at least around the outflow opening for emptying a container, whereas in the open position the top surface of the latch is distant from the bottom surface of the lid.

Preferably, the means intended to initiate the movement of the latch is the protrusion located on the top surface of the latch, where the said protrusion may be found within the outflow opening of the lid.

Preferably, there is an opening in the latch in its axis of rotation, and a cylindrical protrusion on the bottom surface of the lid, where the said protrusion is found within the said opening in the latch.

Preferably, there is a guide formed on the cylindrical protrusion on its side cylindrical surface, and there is a hatch formed on the latch, at the rim of the said opening, where the said hatch is fitted slidingly on the said guide.

Preferably, there are two guides on the bottom surface of the lid positioned parallel to each other and the latch is fitted with two corresponding hatches positioned parallel to each other and fitted slidingly on the said guides; alternatively, there are two guides on the bottom surface of the lid positioned opposite to each other, and the latch features at least one hatch fitted slidingly on the said guides.

Preferably, formed on the longitudinal wall of the outflow opening is at least one protuberance which in the closed position is in contact with the protrusion initiating movement of the latch.

Preferably, there is an opening in the lid to supply air to the container while it is being emptied, where in the closed position the opening is in contact with the top surface of the latch, and where found within the said opening on the top surface of the latch may be the protrusion to initiate the movement of the latch.

Preferably, there is an opening in the latch to supply air to the container while it is being emptied.

Preferably, between the bottom surface of the lid and the top surface of the latch, around the outflow opening, there is a sealing material, and preferably there is a sealing material between the bottom surface of the lid and the top surface of the latch around the opening which supplies air to the container while it is being emptied.

The lid and the latch may be flat or concave towards the inside of the container.

The solution according to the described invention meets the intended purposes. In particular, the screw-like shape of the guides in the lid and the matching hatches in the latch enable immediate distancing of the latch with respect to the bottom surface of the lid when the uncovering of the outflow opening starts, which substantially reduces the force of friction between the elements cooperating with one another during the opening and reclosing of the outflow opening. Moreover, the structure of the mechanism according to the invention makes it possible to use the same material to produce the container, lid, and latch, and guarantees they are non-detachable in the process of use.

BRIEF DESCRIPTION OF THE DRAWINGS

These and other characteristics of the invention will be clear from the following description of a preferential form of embodiment, given as a non-restrictive example, with reference to the attached drawings wherein:

FIG. 27, 27A show the connection between the latch and the lid, as in FIGS. 26 and 26A, respectively, in cross section;

FIG. 28, FIG. 28A show the diagram of assembly of the latch in the lid in the flat variant, in cross section;

DETAILED DESCRIPTION OF THE PREFERRED EMBODIMENTS

Figure 1:
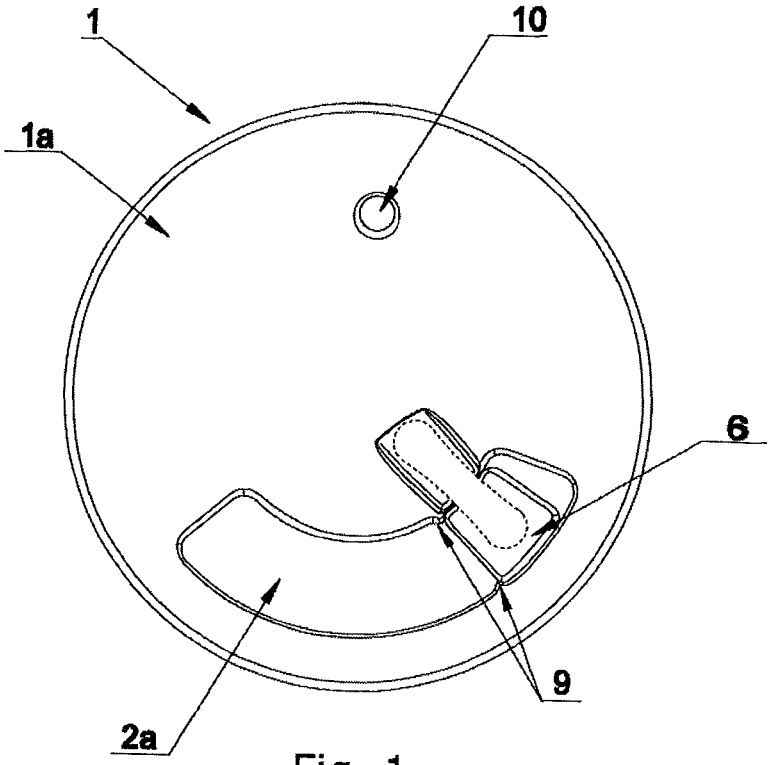
FIG. 1 presents the lid with the latch in place, with the tongue placed in the outflow opening, in the closed position, viewed from the top.
Figure 2:
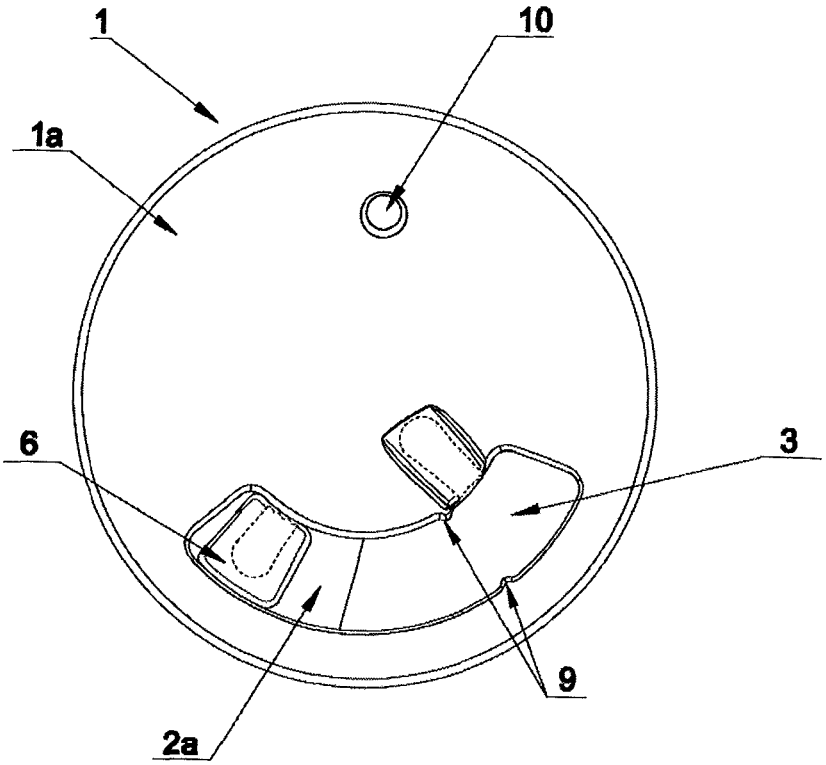
FIG. 2 shows the lid with the latch in place as in FIG. 1, in the open position, viewed from the top.
Figure 3:
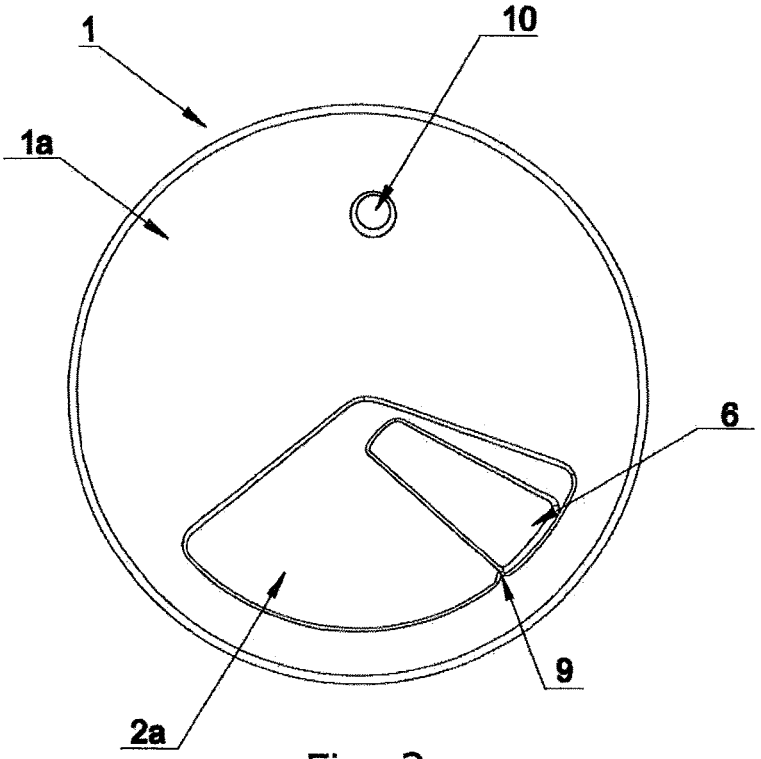
FIG. 3 depicts the lid with the latch in place, with the tongue found within the outflow opening, in the closed position, viewed from the top.
Figure 4:
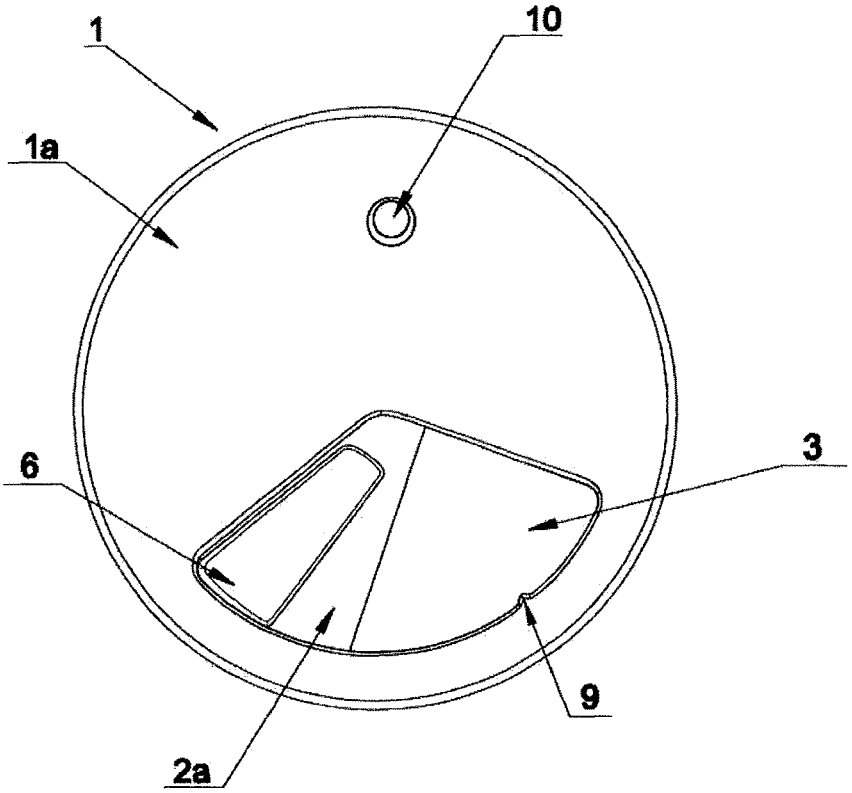
FIG. 4 presents the lid with the latch in place, as in FIG. 3, in the open position, viewed from the top.
Figure 5:
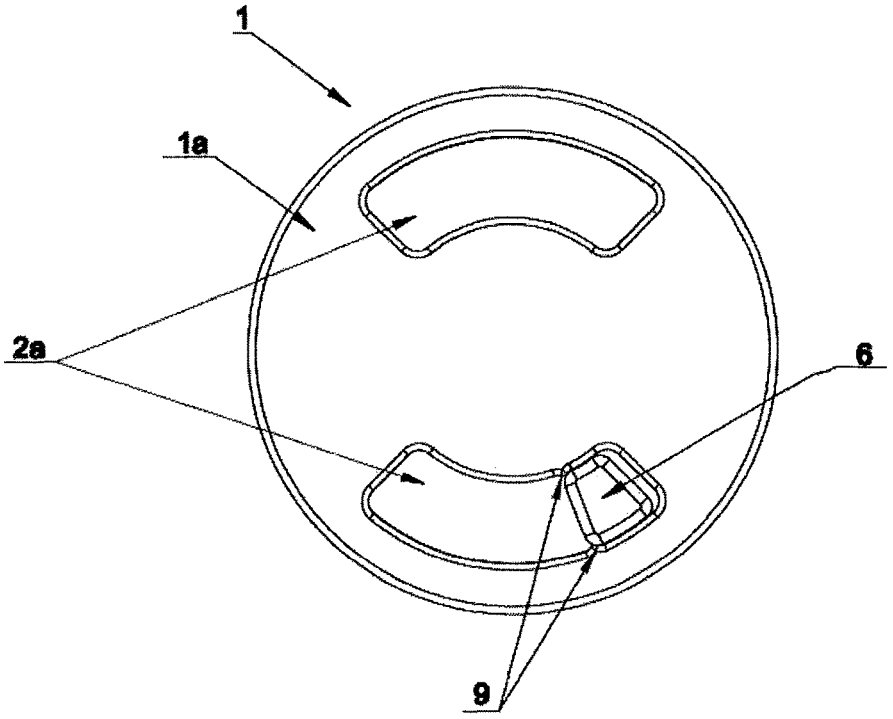
FIG. 5 depicts the lid with the latch in place, with the tongue found within the opening which supplies air to the container while it is being emptied, in the closed position, viewed from the top.
Figure 6:
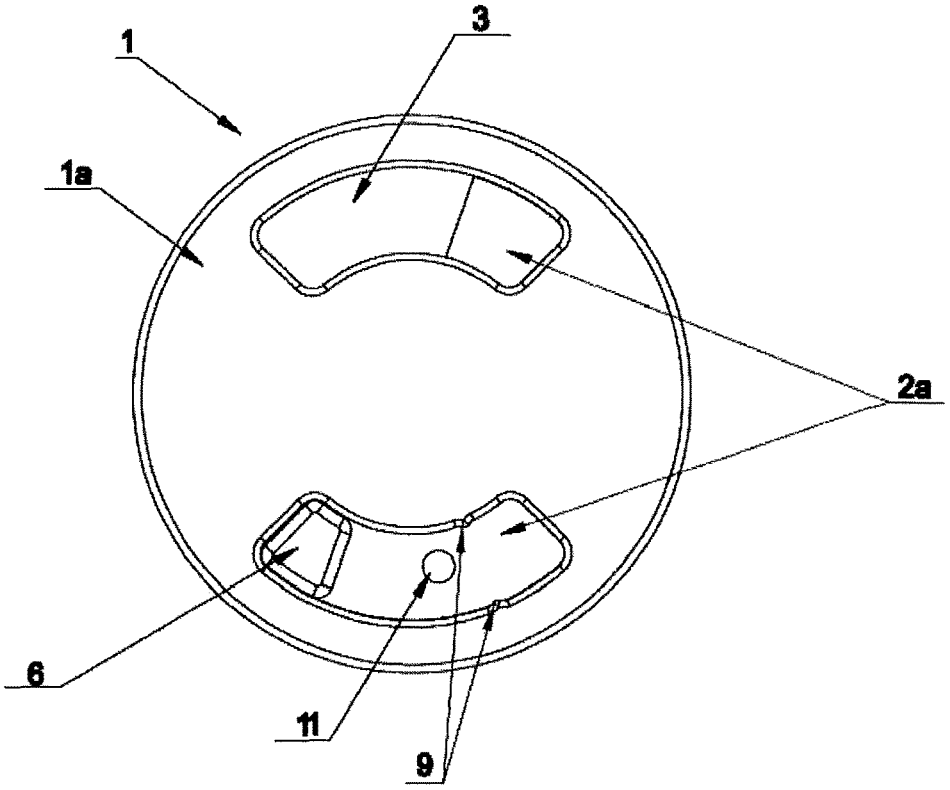
FIG. 6 shows the lid with the latch in place, as in FIG. 5, in the open position, viewed from the top.
Figure 7:
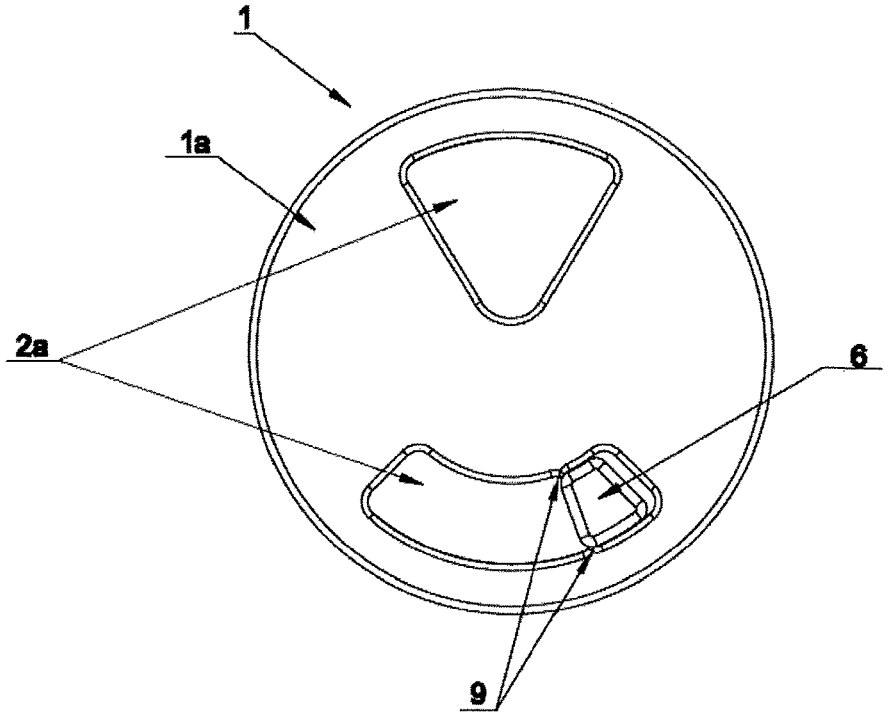
FIG. 7 presents the lid with the latch in place, with the tongue found within the opening which supplies air to the container while it is being emptied, in the closed position, viewed from the top.
Figure 8:
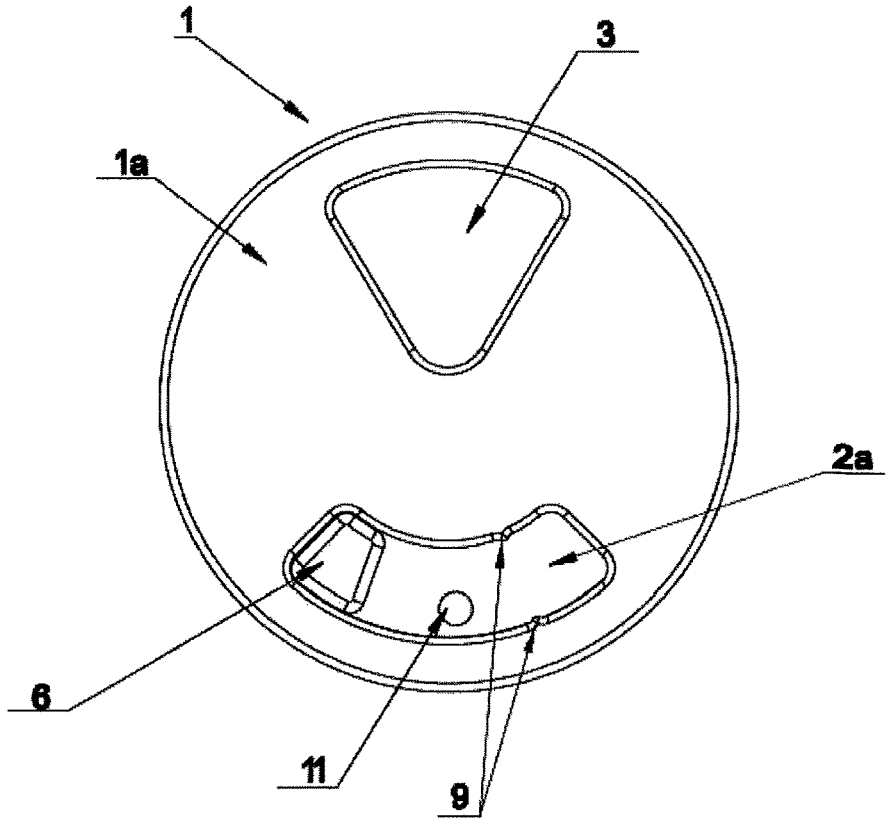
FIG. 8 shows the lid with the latch in place, as in FIG. 7, in the open position, viewed from the top.

An exemplary mechanism for opening and reclosing the outflow opening for emptying a container incorporates a latch 2 featuring the means intended to initiate movement of the latch, for instance in the form of a protrusion 6 placed on the bottom surface 2*a* of the latch 2. The lid 1 features an outflow opening 3 which may come in different shapes, such as a section of a ring, as in FIG. 1, FIG. 2, FIG. 5, FIG. 6, or a triangle, as in FIG. 3, FIG. 4, FIG. 7, FIG. 8. The said protrusion 6 may be placed within the outflow opening 3 of the lid 1, as presented in FIG. 1 to FIG. 4, which limits the movement of the latch 2 in the outflow opening 3 from the closed position to the open position and backwards; alternatively, the said protrusion 6 may be placed within the opening 10 which supplies air to the container while it is being emptied, as shown in FIG. 5 to FIG. 8, and which limits the movement of the latch 2 in the said opening from the closed position to the open position and backwards. The latch 2 is rotationally connected to the lid 1 via at least one guide 4 formed on the bottom surface 1*b* of the lid 1, where the guide cooperates with the hatch 5 formed on the bottom surface 2*b* of the latch 2. The said guide 4 formed on the bottom surface of the lid 1 features an arched guiding surface 4*a* which goes down in a screw-like manner with respect to the bottom surface 1*b* of the lid 1, while formed on the bottom surface 2*b* of the latch 2 is a hatch 5 featuring an arched surface 5*a* which goes down in a screw-like manner with respect to the bottom surface 2*a* of the latch 2. The hatch 5 is fitted slidingly on the said guide 4, so that the arched surface 5*a* of the hatch 5 contacts the arched guiding surface 4*a* of the guide 4.

Figure 9:
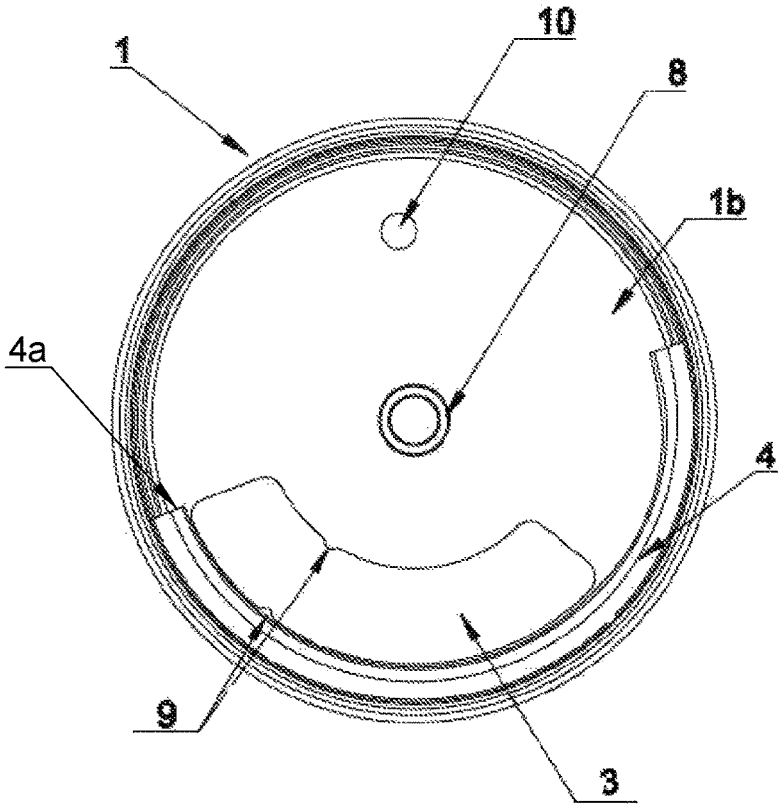
FIG. 9 presents the lid with a single guide, viewed from the bottom.
Figure 12:
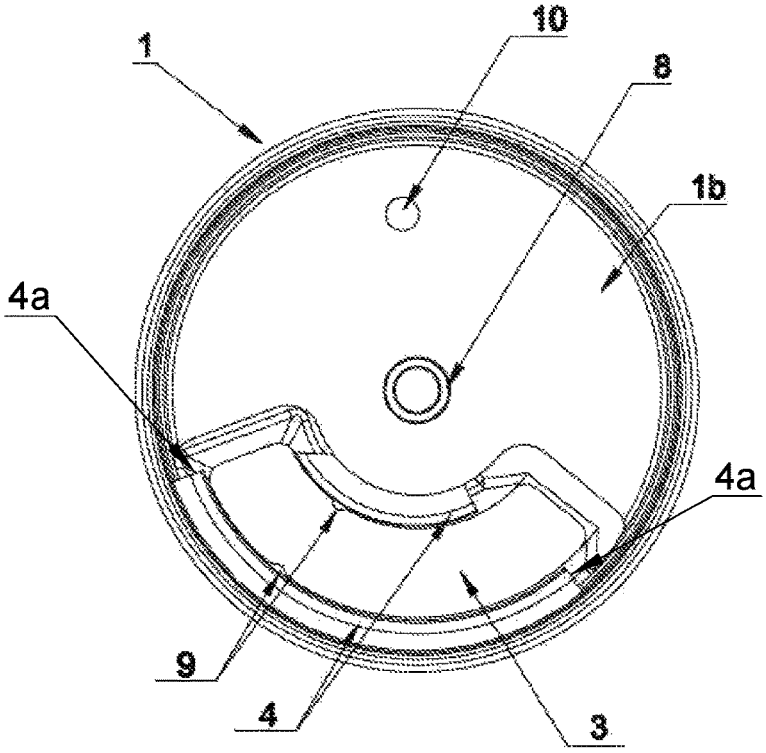
FIG. 12 depicts the lid with two guides parallel to each other, and the surface profiled around the outflow opening, viewed from the bottom.
Figure 15:
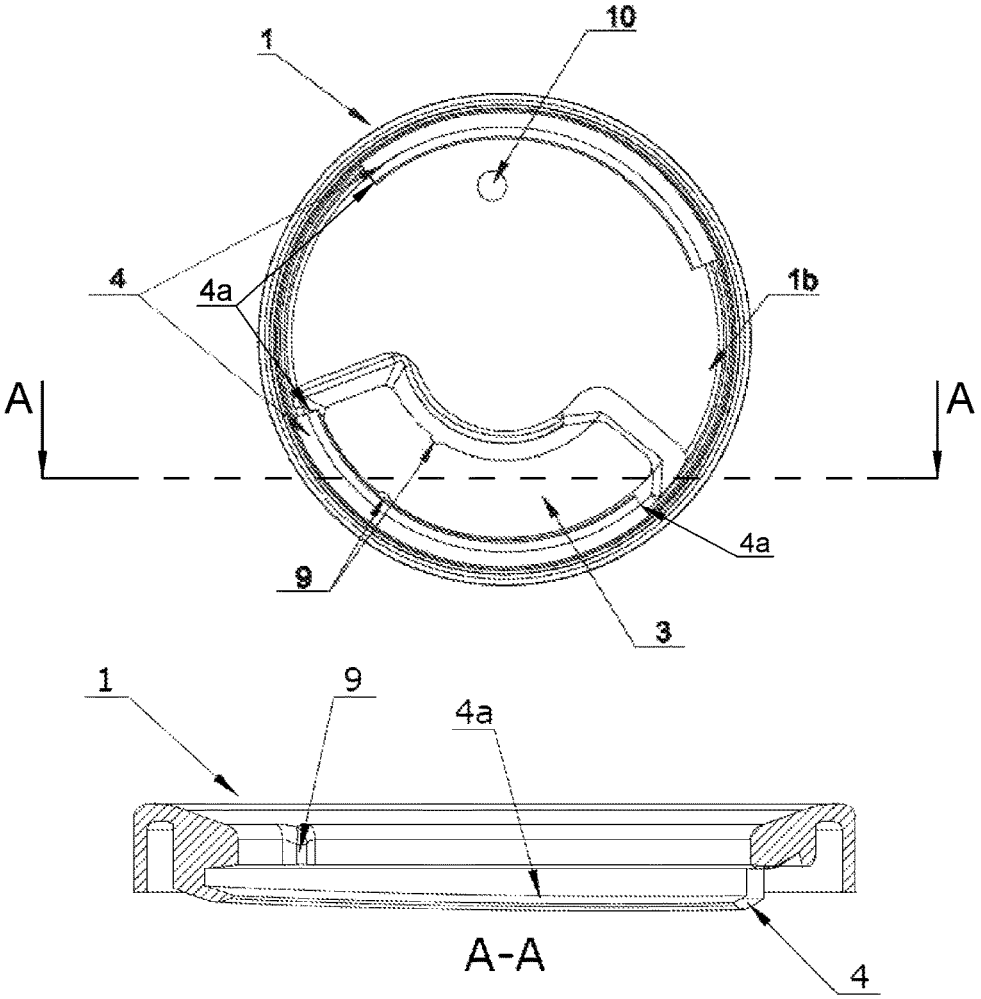
FIG. 15 depicts the lid with two guides positioned opposite each other, with the profiled surface around the outflow opening, viewed from the bottom.
Figure 18:
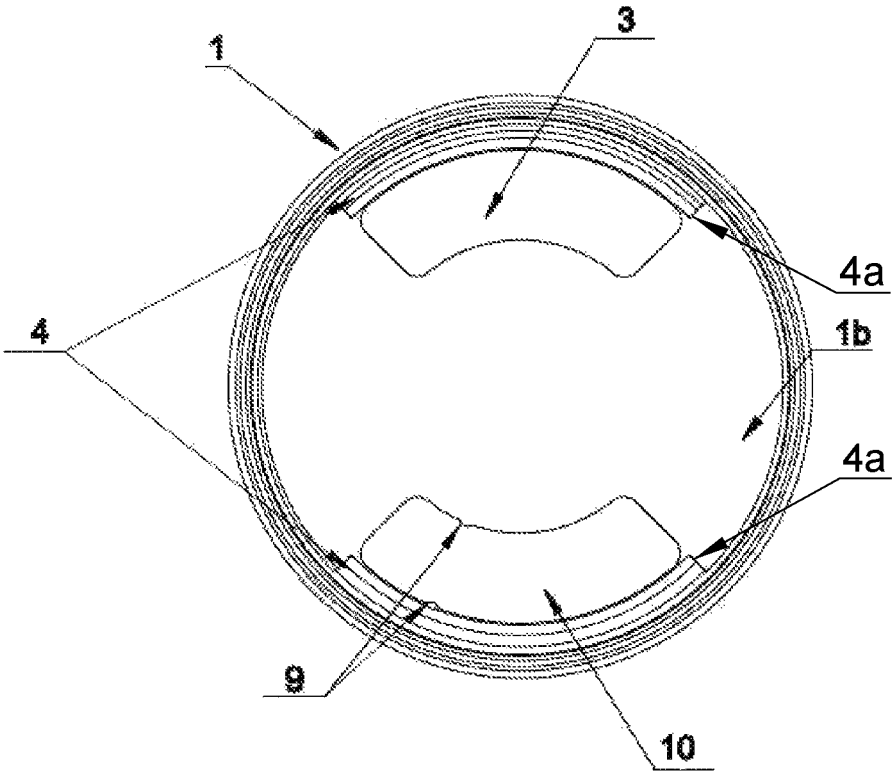
FIG. 18, 18A depict the lid with two guides positioned opposite each other, viewed from the bottom.
Figure 18A:
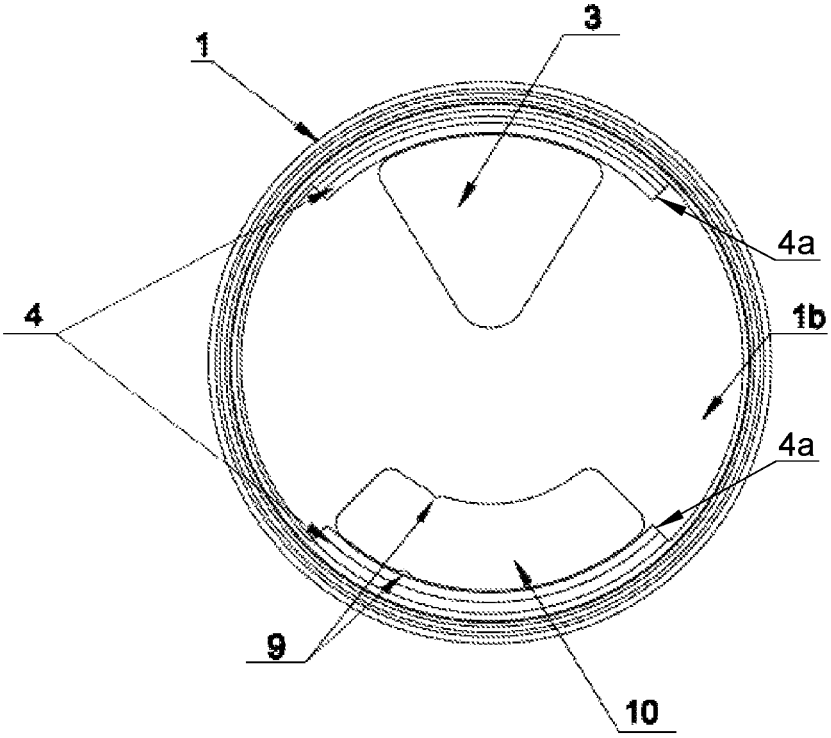

In one of the embodiment variants, the bottom surface 1*b* of the lid around the outflow opening 3 may be profiled, as shown in FIG. 12 and FIG. 15, into an extending rim, in which case, when in the closed position, the top surface 2*a* of the latch 2 contacts that rim profiled on the bottom surface 1*b* of the lid 1 around the outflow opening 3, while in another variant, as shown in FIG. 9, FIG. 18, FIG. 18A, the surface around the outflow opening 3 features no distinct rim, in which case, when in the closed position, the top surface 2*a* of the latch 2 contacts the bottom surface 1*b* of the lid 1, while in the open position the top surface 2*a* of the latch 2 is distant from the bottom surface 1*b* of the lid 1 in all exemplary embodiments.

Figure 10:
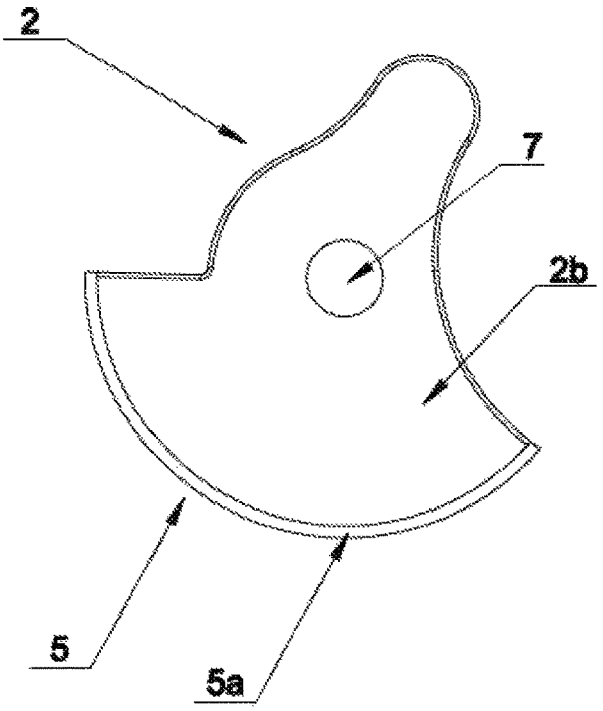
FIG. 10, 10A show the latch matching the lid as in FIG. 9, viewed from the bottom.
Figure 10A:
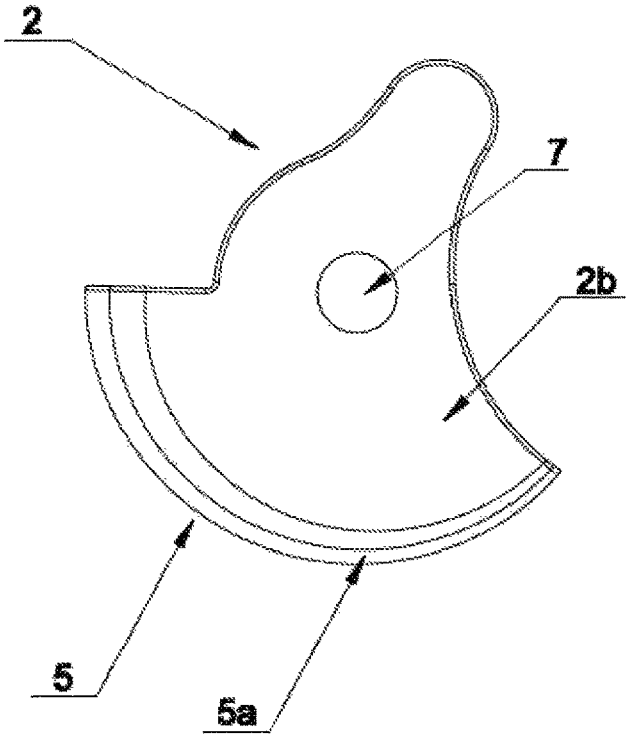
Figure 11:
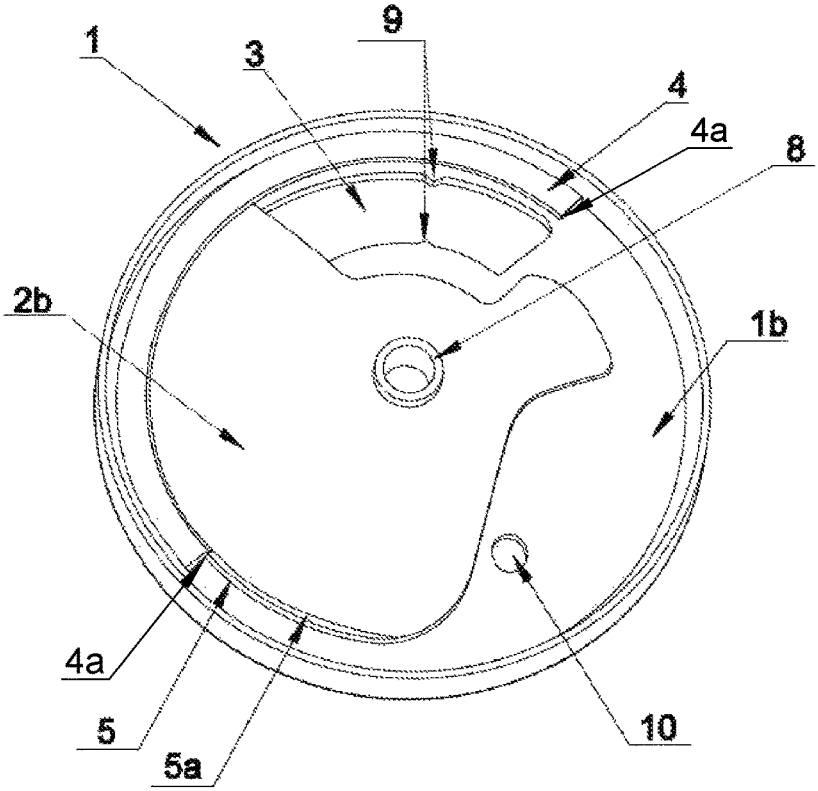
FIG. 11 presents the lid as in FIG. 9 with the latch in place, as in FIG. 10, 10A, in the open position, in a 3D view from the bottom.

According to the exemplary embodiment shown in FIG. 9 to FIG. 11, the lid features a single guide 4 (FIG. 9) on the bottom surface 1*b*, and correspondingly the latch 2 features a single hatch 5 which can be given the shape as in FIG. 10 or FIG. 10A and which is fitted slidingly on the said guide 4 (FIG. 11), as described above. Moreover, the latch 2 features an opening 7 in its axis of rotation, and there is a cylindrical protrusion 8 formed on the bottom surface 1*b* of the lid 1, where the protrusion is placed within the said opening 7 of the latch 2. Moreover, the lid 1 features an opening 10 which supplies air to the container in the open position (FIG. 11), when the container is being opened. On the other hand, while in the closed position, the opening 10 is in contact with the top surface 2*a* of the latch 2.

Figure 13:
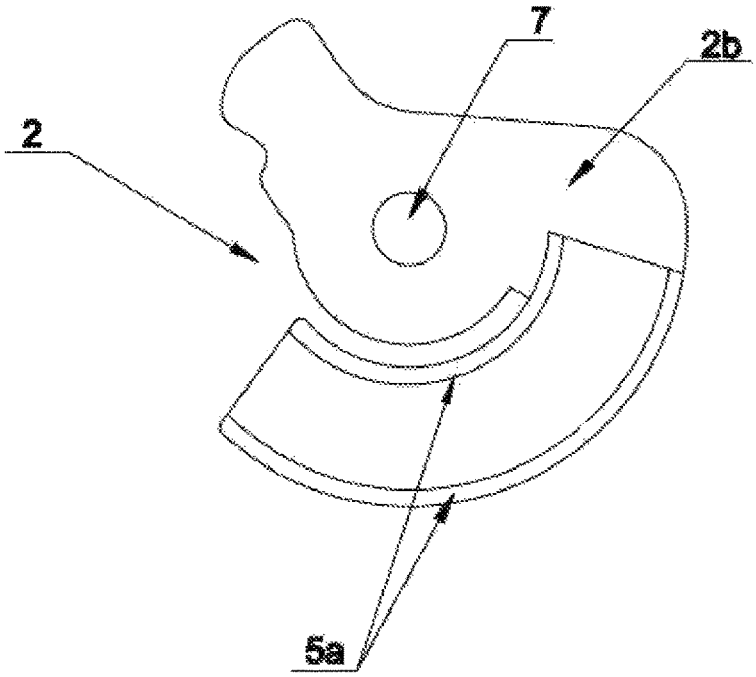
FIG. 13 depicts the latch matching the lid as in FIG. 12, viewed from the bottom.
Figure 14:
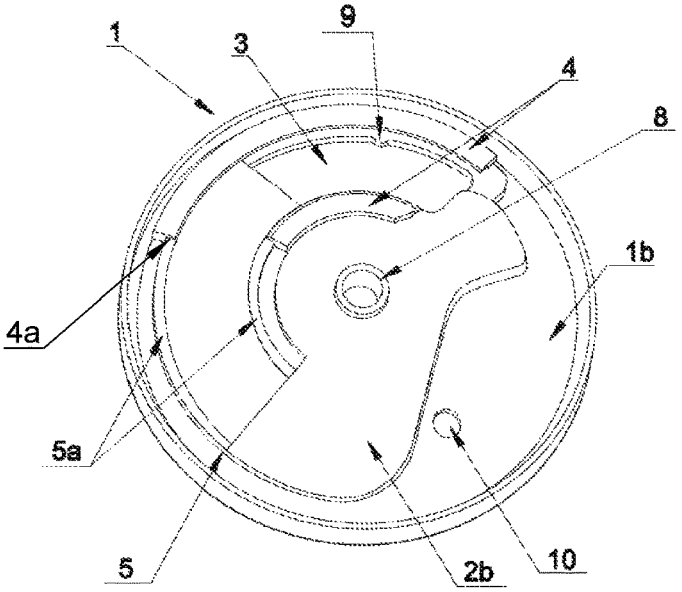
FIG. 14 presents the lid as in FIG. 12 with the lid in place, as in FIG. 13, in the open position, in a 3D view form the bottom.

According to another exemplary embodiment, as shown in FIG. 12 to FIG. 14, on the bottom surface 1*b* of the lid 1 there are two guides 4 positioned parallel to each other (FIG. 12), and on the latch 2 there are, correspondingly, two hatches 5 positioned parallel to each other (FIG. 13) and fitted slidingly on the said guides 4 (FIG. 14), as described above. Moreover, the latch 2 features an opening 7 in its axis of rotation, and the lid 1 features a cylindrical protrusion 8 on its bottom surface 1*b*, where the said protrusion is placed within the said opening 7 of the latch 2. In addition, the lid 1 features an opening 10 which supplies air to the container in the open position (FIG. 14) while the container is being emptied. On the other hand, while in the closed position, the opening 10 is in contact with the top surface 2*a* of the latch 2.

Figure 16:
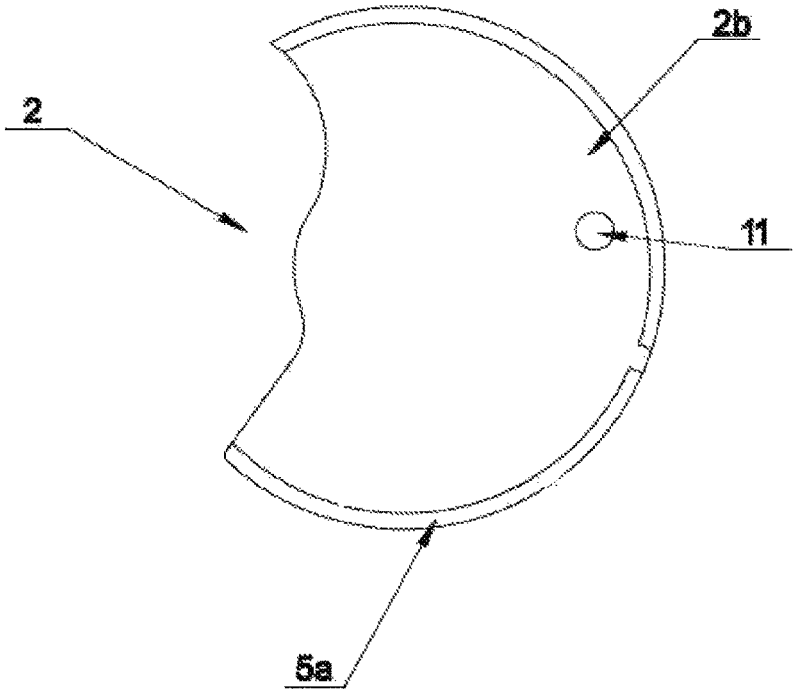
FIG. 16 shows the lid with two hatches for the lid, as in FIG. 15, viewed from the bottom.
Figure 17:
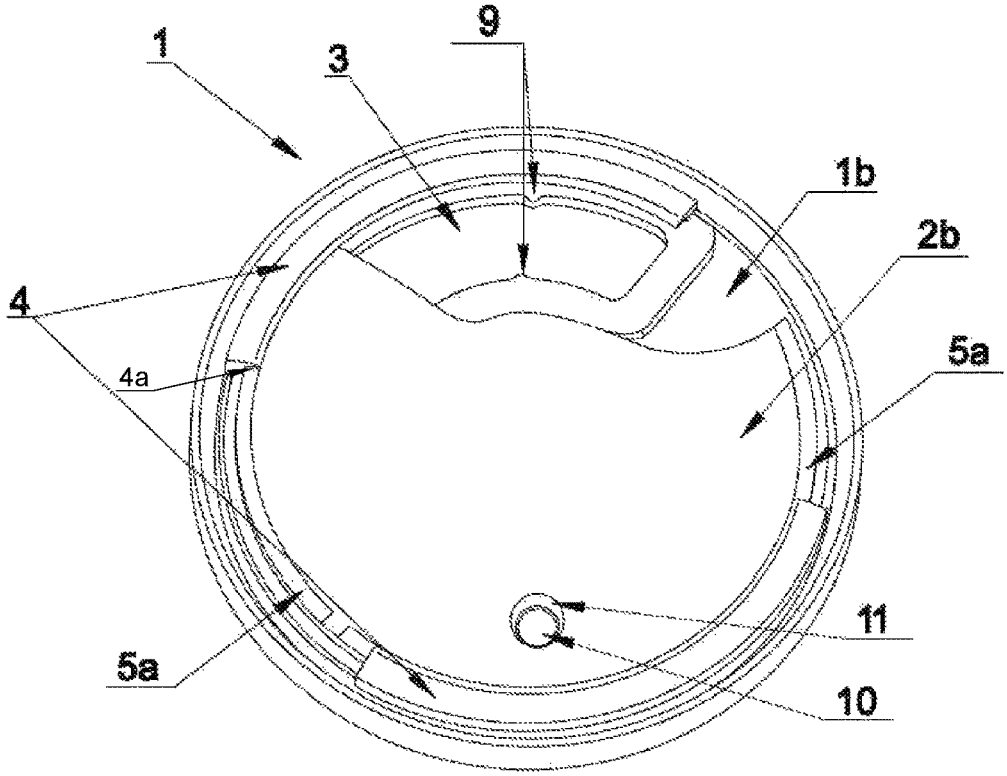
FIG. 17 presents the lid as in FIG. 15 with the latch in place, as in FIG. 16, in the open position, in a 3D view from the bottom.

According to yet another exemplary embodiment, as shown in FIG. 15 to FIG. 17, on the bottom surface 1*b* of the lid 1 there are two guides 4 positioned opposite each other (FIG. 15), and on the latch 2 there are, correspondingly, two hatches 5 (FIG. 16) fitted slidingly on the said guides 4 (FIG. 17). In addition, the lid 1 features an opening 10 to supply air to the container in the open position (FIG. 15), and the latch 2 features a corresponding opening 11 (FIG. 16) to supply air to the container in the open position, where the openings 10, 11 overlap each other in the open position (FIG. 17), whereas in the closed position the said opening 10 in the lid is in contact with the top surface 2*a* of the latch 2.

Figure 19:
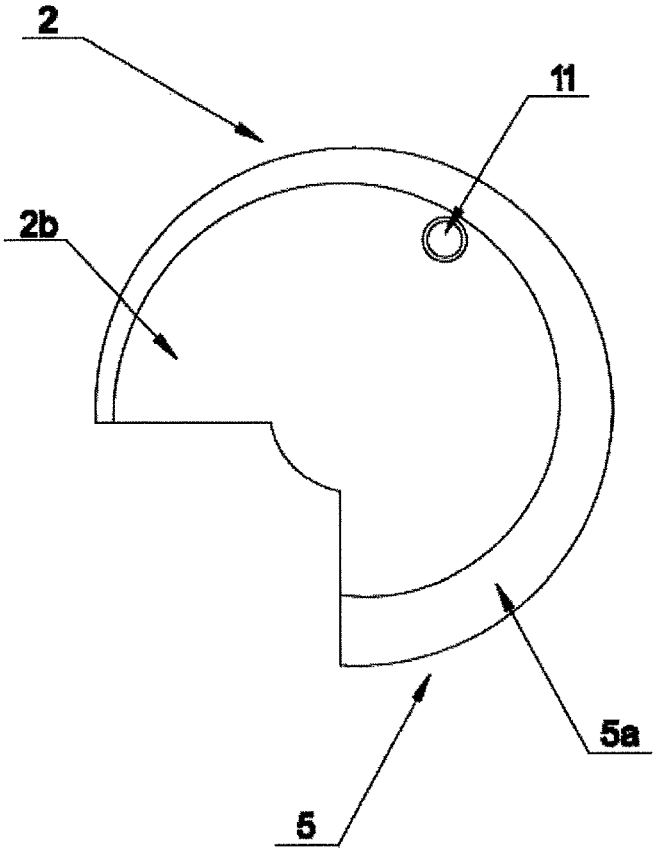
FIG. 19, 19A depict the latch with a single hatch for the lid as in FIG. 18, 18A, viewed from the bottom.
Figure 19A:
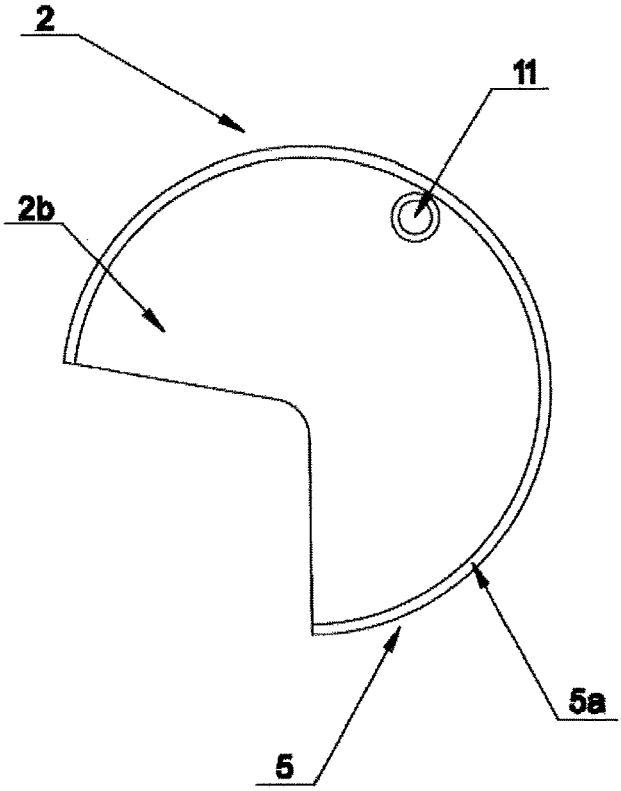
Figure 20:
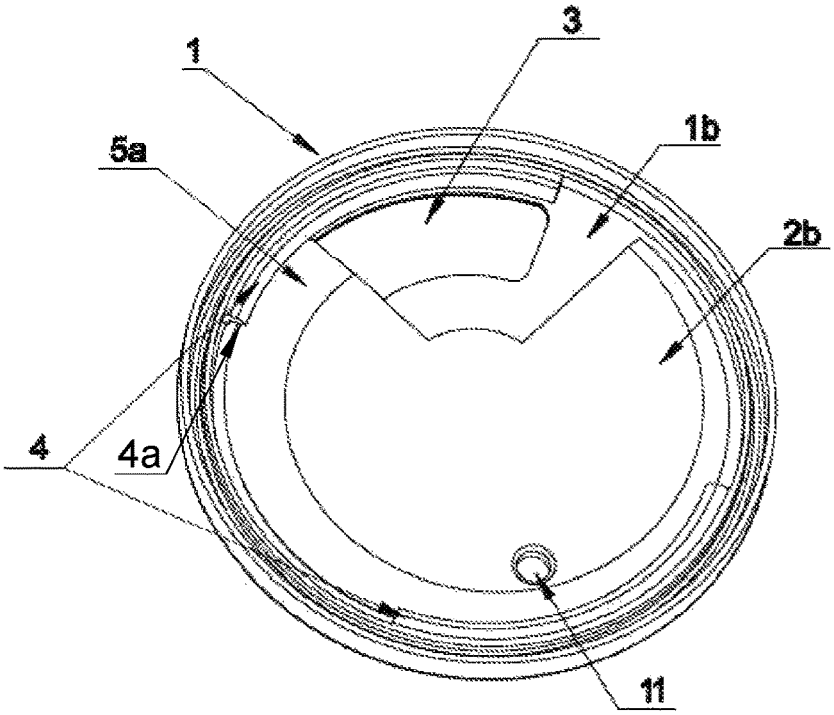
FIG. 20 shows the lid as in FIG. 18 with the lid in place, as in FIG. 19 or 19A, in the open position, in a 3D view from the bottom.
Figure 21:
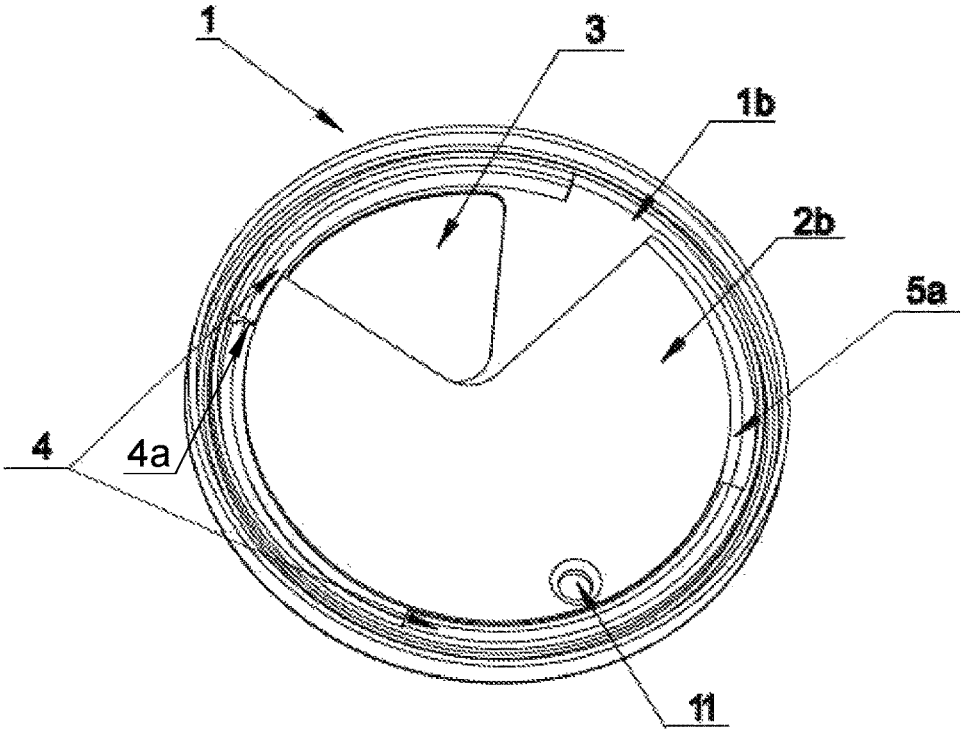
FIG. 21 presents the lid as in FIG. 18A, with the latch in place, as in FIG. 19 or 19A, in the open position, in a 3D view from the bottom.

According to other embodiment variants, as shown in FIG. 18, 18A, 19, 20, 21, on the bottom surface 1*b* of the lid 1 there are two guides 4 positioned opposite each other (FIG. 18, FIG. 18A), and on the latch 2 there is a single hatch 5 which can be given the shape as in FIG. 19 or 19A, where the latch is fitted slidingly on the said guides 4, as shown in FIG. 20, FIG. 21, respectively. In addition, there is an opening 10 in the lid 1 (FIG. 18, 18A) to supply air to the container in the open position, and the latch 2 (FIG. 19, 19A) features a corresponding opening 11 to supply air to the container in the open position, where the openings 10, 11 overlap each other in the open position (FIG. 20, FIG. 21), whereas in the closed position the said opening 10 in the lid is in contact with the top surface 2*a* of the latch 2.

According to yet another exemplary embodiment of the invention (not shown on the drawing) there may be a guide 4 formed on the side cylindrical surface of the cylindrical protrusion 8 formed on the bottom surface 1*b* of the lid 1, in which case there is a hatch 5 formed on the bottom surface 2*b* of the latch 2, on the rim of the opening 7, where the hatch is fitted slidingly on the said guide 4.

In all exemplary embodiments described above, formed on the longitudinal wall of the outflow opening 3 or the opening 10 which supplies air to the container in the open position may be one or two protuberances 9 (FIG. 1 to FIG. 8), which in the closed position are in contact with the protrusion 6 which initiates the movement of the latch 2 (FIG. 1, FIG. 3, FIG. 5, FIG. 7).

In all exemplary embodiments described above, there may be a sealing material fitted between the bottom surface 1*b* of the lid 1 and the top surface 2*a* of the latch, around the outflow opening 3, and between the bottom surface 1*b* of the lid 1 and the top surface 2*a* of the latch 2, around the opening 10 which supplies air to the container while it is being emptied.

Figure 22:
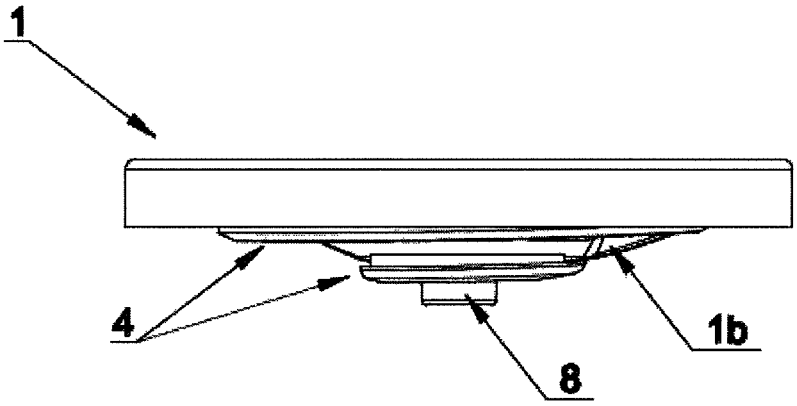
FIG. 22 depicts the lid as in FIG. 12, in the concave variant, viewed from the side.
Figure 23:
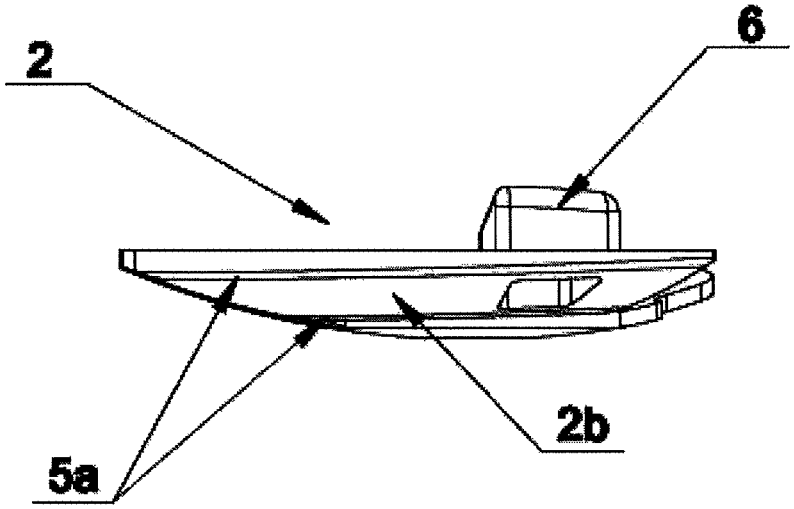
FIG. 23 shows the latch for the lid as in FIG. 22, viewed from the side.
Figure 24:
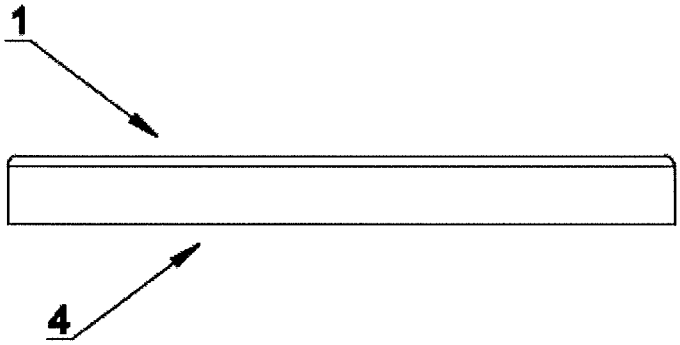
FIG. 24 presents the lid as in FIG. 18, in the flat variant, viewed from the side.
Figure 25:
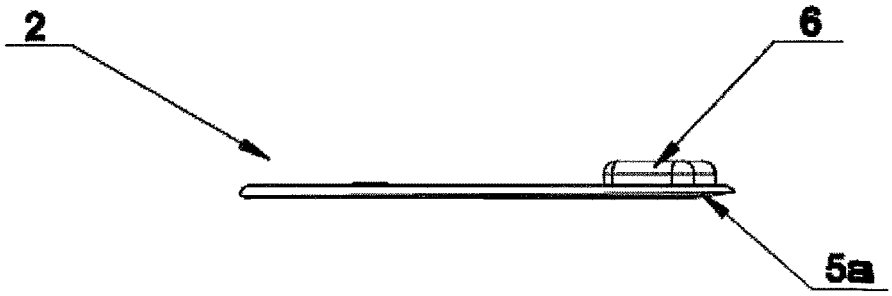
FIG. 25 shows the latch for the lid, as in FIG. 24, viewed from the side.
Figure 26:
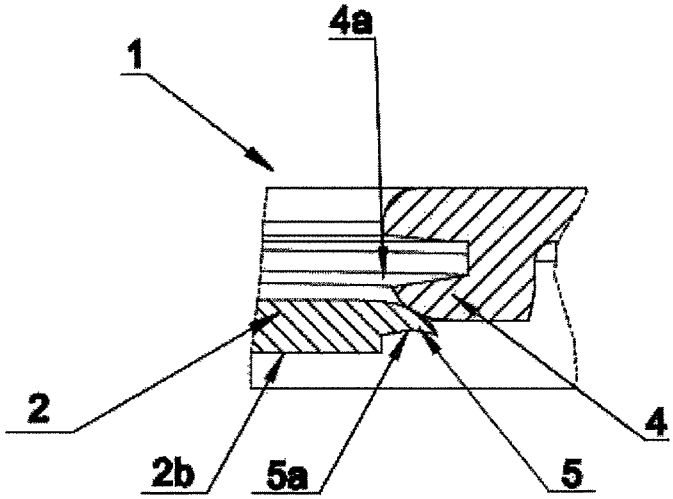
FIG. 26, FIG. 26A present the diagram of assembly of the latch in the lid, in the concave variant, in cross section.
Figure 26A:
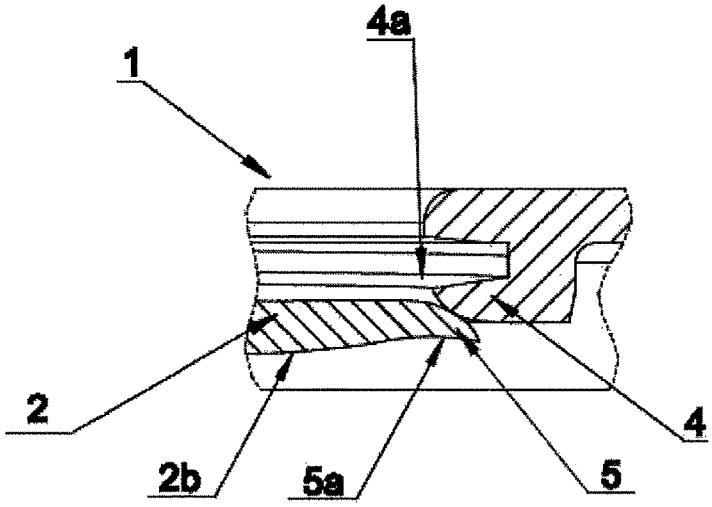
Figure 28A:
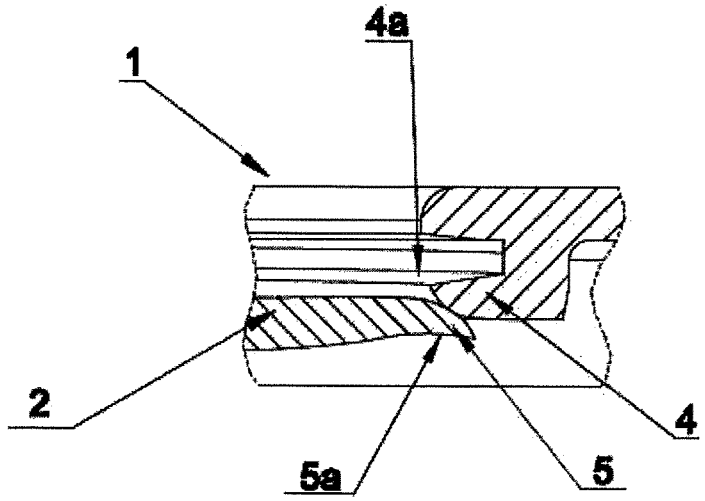
Figure 29:
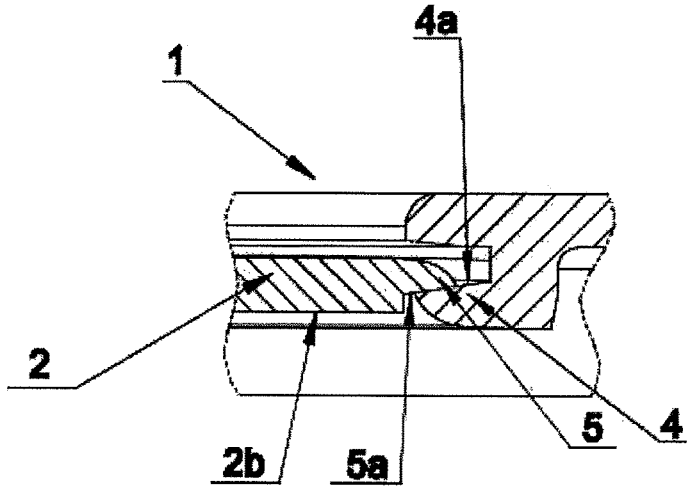
FIG. 29, 29A depict the connection between the latch and the lid, as in FIGS. 28 and 28A, respectively, in cross section.
Figure 29A:
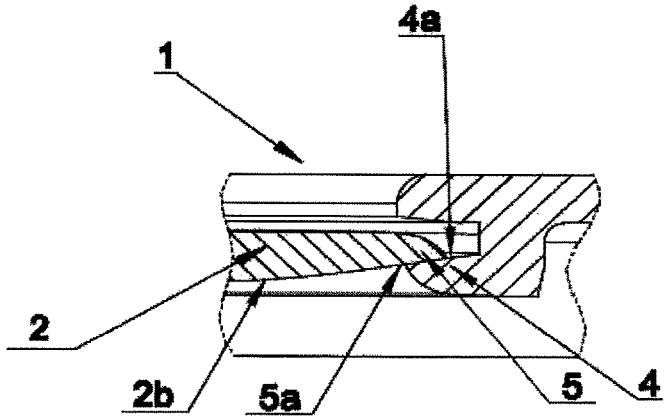

In all exemplary embodiments described above, the lid 1 and the latch 2 may be concave towards the inside of the container, as shown exemplarily in FIG. 22 and FIG. 23 (for the exemplary embodiment as in FIG. 12-14), or in FIG. 26, 26A, FIG. 27, FIG. 27A; alternatively, the lid 1 and the latch 2 may be flat, which exemplarily shown in FIG. 24 and FIG. 25 (for the exemplary embodiment as in FIG. 18 to FIG. 21), as well as in FIG. 28, 28A, 29, 29A.

In all exemplary embodiments described above the arched surface 5*a* of the hatch 5 may be profiled by scooping so that a sudden step is formed on the bottom surface 2*b* of the latch 2, as shown in FIG. 26, FIG. 27, FIG. 28, FIG. 29; alternatively, the surface may be profiled without the step (gradual change), as shown in FIG. 26A, FIG. 27A, 28A, 29A.

The latch 2 is assembled in the lid 1 by applying force, in effect of which, once the latch 2 is first oriented with respect to the lid 1, the hatches 5 are slipped onto the guides 4, as shown schematically in FIG. 26, FIG. 26A, FIG. 28, FIG. 28A, and the tongue is placed either in the outflow opening 3, or in the opening 10 which supplies air to the container while it is being emptied. The connection between the latch and the lid following the assembly is shown schematically in FIG. 27, 27A, FIG. 29, FIG. 29A.

The outflow opening 3 is opened by shifting the protrusion 6 along the outflow opening 3 (FIG. 1 to FIG. 4), or by shifting the protrusion 6 along the opening 10 which supplies air to the container while it is being emptied (FIG. 5 to FIG. 8).

The shifting of the said protrusion 6 causes rotation of the latch 2 on the guides 4 of the lid 1, and while the latch 2 rotates, the distance between its top surface 2*a* and the bottom surface 1*b* of the lid 1 increases. The outflow opening can be reclosed.

The lid and the latch are made of the same resilient plastic material.

LIST OF NUMERICAL REFERENCES

1—lid
1*a*—top surface of the lid
1*b*—bottom surface of the lid
2—latch
2*a*—top surface of the latch
2*b*—bottom surface of the latch
3—outflow opening in the lid
4—guide formed on the bottom surface of the lid
4*a*—arched guiding surface of the guide
5—hatch of the latch
5*a*—arched surface of the hatch
6—protrusion on the top surface of the latch
7—axial opening in the latch
8—cylindrical protrusion on the bottom surface of the lid
9—protuberance
10—opening in the lid to supply air to the container while it is being emptied
11—opening in the latch to supply air to the container while it is being emptied

The invention claimed is:

1. A mechanism for opening and reclosing an outflow opening in a lid of a container for emptying the container comprising a latch comprising a protrusion to initiate movement of the latch, located on a top surface of the latch, wherein the latch is connected rotationally to the lid;

at least one arched guide (4) formed on a bottom surface (1*b*) of the lid (1), with an arched guiding surface (4*a*) going down rotationally with respect to the bottom surface (1*b*) of the lid (1);

at least one arched hatch (5) with an arched surface (5*a*) shaped on a bottom surface (2*b*) of the latch (2), wherein said arched surface (5*a*) goes down rotationally with respect to the top surface (2*a*) of the latch (2), wherein the hatch (5) is fitted slidingly on said arched guide (4), so that the arched surface (5*a*) of the latch (2) contacts the arched guiding surface (4*a*) of the arched guide (4), wherein the lid (1) and the latch (2) are configured such that in a closed position the top surface (2*a*) of the latch (2) contacts the bottom surface (1*b*) of the lid (1) at least around the outflow opening (3) for emptying the container, whereas in an open position the top surface (2*a*) of the latch (2) is distant from the bottom surface (1*b*) of the lid (1); and wherein the open and closed positions are based on the rotation of the latch (2) by application of force on the protrusion to rotate the latch (2) along the arched guide (4).

2. The mechanism according to claim 1, wherein the protrusion (6) is found within the outflow opening (3) of the lid (1).

3. The mechanism according to claim 1, wherein the mechanism comprises an opening (7) in the latch (2) in an axis of rotation of the latch (2), and a cylindrical protrusion (8) on the bottom surface (1*b*) of the lid (1), wherein said protrusion is found within the opening (7) of the latch (2).

4. The mechanism according to claim 3, wherein the mechanism comprises an arched guide (4) formed on a side cylindrical surface of the cylindrical protrusion (8) and wherein there is an arched hatch (5) formed on the latch (2), at a rim of the opening (7), wherein said arched hatch (5) is fitted slidingly on said guide (4).

5. The mechanism according to claim 1, wherein the mechanism comprises two guides (4) on the bottom surface (1*b*) of the lid (1) positioned parallel to each other, and the latch (2) is fitted with two corresponding hatches (5) positioned parallel to each other and fitted slidingly on said arched guides (4).

6. The mechanism according to claim 1, wherein the mechanism comprises two guides (4) on the bottom surface (1*b*) of the lid (1) positioned opposite each other, and the latch (2) features the at least one arched hatch (5) fitted slidingly on said arched guides (4).

7. The mechanism according to claim 3, wherein formed on a longitudinal wall of the outflow opening (3) is at least one protuberance (9) which in the closed position is in contact with the protrusion (6) initiating a movement of the latch (2).

8. The mechanism according to claim 1, wherein the mechanism comprises an opening (10) in the lid (1) to supply air to the container while the container is being emptied, wherein in a closed position the opening is in contact with the top surface (2*a*) of the latch (2).

9. The mechanism according to claim 8, wherein the mechanism comprises an opening (11) in the latch (2) to supply air to the container while the container is being emptied.

10. The mechanism according to claim 8, wherein the protrusion (6) to initiate a movement of the latch (2) positioned on the top surface (2*a*) of the latch (2) is located within the opening (10) of the lid (1) which supplies air to the container when the container is being emptied.

11. The mechanism according to claim 7, wherein formed on a longitudinal wall of the opening (10) which supplies air to the container while the container is being emptied is the at least one protuberance (9) which in a closed position is in contact with the protrusion (6) to initiate a movement of the latch (2).

12. The mechanism according to claim 1, wherein the mechanism comprises a sealing material between the bottom surface (1*b*) of the lid (1) and the top surface (2*a*) of the latch (2) around an outflow opening (7).

13. The mechanism according to claim 8, wherein the mechanism comprises a sealing material between the bottom surface (1*b*) of the lid (1) and the top surface (2*a*) of the latch (2) around the opening (10) which supplies air to the container while the container is being emptied.

* * * * *